US007857164B2

(12) United States Patent
Jarisch et al.

(10) Patent No.: US 7,857,164 B2
(45) Date of Patent: Dec. 28, 2010

(54) DEVICE FOR SELECTION OF CAPSULES CONTAINED IN A STACK

(75) Inventors: Christian Jarisch, Paudex (CH); Alfred Yoakim, St.-Legier-la-Chiesaz (CH)

(73) Assignee: Nestec S.A., Vevey (CH)

( * ) Notice: Subject to any disclaimer, the term of this patent is extended or adjusted under 35 U.S.C. 154(b) by 654 days.

(21) Appl. No.: 11/568,620

(22) PCT Filed: Apr. 1, 2005

(86) PCT No.: PCT/EP2005/003425

§ 371 (c)(1),
(2), (4) Date: Nov. 3, 2006

(87) PCT Pub. No.: WO2005/104908

PCT Pub. Date: Nov. 10, 2005

(65) Prior Publication Data

US 2007/0170203 A1 Jul. 26, 2007

(30) Foreign Application Priority Data

May 5, 2004 (EP) ..... 04010645

(51) Int. Cl.
*B65H 3/28* (2006.01)

(52) U.S. Cl. ..... 221/223; 221/133; 221/221; 221/222; 221/230; 221/241; 221/297

(58) Field of Classification Search ..... 221/133, 221/230, 241, 297, 221, 222, 223
See application file for complete search history.

(56) References Cited

U.S. PATENT DOCUMENTS

| | | | | | |
|---|---|---|---|---|---|
| 1,621,098 | A | * | 3/1927 | Anderson et al. | 221/297 |
| 2,037,751 | A | * | 4/1936 | Barbieri | 221/223 |
| 2,268,421 | A | * | 12/1941 | Reifsnyder et al. | 221/222 |
| 2,489,096 | A | | 11/1949 | Lime | |
| 2,730,268 | A | * | 1/1956 | Moesch | 221/221 |
| 3,279,652 | A | * | 10/1966 | Willvonseder | 221/223 |
| 4,804,108 | A | | 2/1989 | Ficken | |
| 4,829,889 | A | * | 5/1989 | Takeuchi et al. | 99/289 P |
| 6,471,092 | B1 | * | 10/2002 | Thompson | 221/223 |
| 6,971,546 | B2 | * | 12/2005 | Costa | 221/297 |
| 2003/0146237 | A1 | * | 8/2003 | Costa | 221/270 |
| 2004/0031810 | A1 | | 2/2004 | Thompson | |

FOREIGN PATENT DOCUMENTS

| | | |
|---|---|---|
| DE | 1261646 | 2/1968 |

* cited by examiner

*Primary Examiner*—Timothy R Waggoner
(74) *Attorney, Agent, or Firm*—K&L Gates LLP

(57) ABSTRACT

Device for selection of capsules containing a food product from a, stack of capsules contained in a container, comprising a body (10) which delimits a passage (20) through which the capsules pass by gravity; first stop means (30, 31, 32, 33) for selectively retaining and releasing said first capsule (90); actuating means (8) for actuating said stop means (3, 30, 31, 32, 33) between a stop position and a release position. The first stop means (3, 30, 31, 32, 33) are distributed about the circumference of the passage (20) and are able to move by turning transversely, and simultaneously, towards the inside of the passage to a stop position in order to form several support points distributed under the capsule (90).

16 Claims, 7 Drawing Sheets

DEVICE FOR SELECTION OF CAPSULES CONTAINED IN A STACK

The present invention relates to a device for selection of capsules contained in a stack. The invention concerns in particular the provision and dispensing of capsules of the food type, for example in vending machines, drink-dispensing machines of the coffee machine type, or other types of machines.

In the food sector, the use of systems for preparing food products from capsules, for example drink-dispensing machines, is rapidly expanding because of the many advantages that these systems generally afford. These systems can be drink-dispensing machines, for example, which operate using capsules containing a drink base. Using these capsules, the consumer is able to prepare a drink simply and quickly and in most cases with minimum work involved in preparation and/or cleaning.

These capsules can, for example, be portioned packages of very varied shape, size and/or nature. They may be capsules made of plastic film, filter paper, aluminum or composite laminate and can be in the form of cups or pots or other forms.

In the case of intensive use of these machines, there is a need to have sufficient reserves of capsules so as not to run out of stock and/or so as to offer a wider choice of different capsules for preparing different specialties. For this purpose, a capsule store can be provided in the form of a stack within a dedicated space and can serve for provision of capsules according to requirements.

For example, U.S. Pat. No. 6,595,106 relates to a capsule magazine permitting storage of a number of capsules stacked on top of one another. The capsules can thus be removed from the magazine upon demand through an opening formed at the base of the magazine. A disadvantage is that the capsules have to be removed by hand.

US patent application 2004/0031810 concerns a dispenser for flat articles, such as lids, from a stack. This principle aims to separate stacked articles without first isolating the article which is to be made to drop. Thus, the device comprises stop means of short length, such as needles and short blades, the deployment of which in the passage is limited so as to bear only on the edges of the articles and ensure that only the article situated lowest down in the stack is made to drop. This principle does not work when applied to capsules of the invention, the reason being that the capsules have flexible edges which may bend against the stop means, and one or more capsules may therefore drop accidentally. Moreover, the synchronization of such a device is mechanically complicated.

U.S. Pat. No. 2,489,096 concerns a device for selection of cups which functions according to the principle by which the beaker to be dropped is isolated from the rest of the stack. It comprises two series of barrels activated by a tumbler, the two barrels being connected to one another by a single transverse shaft. The transmission forces to be produced on the upper barrel are thus substantial, with a high moment of inertia. Such a device is not particularly robust or reliable from the mechanical point of view because the repeated forces acting on the shaft may cause the latter to twist; this may have an adverse effect on the precision of the device and, consequently, on its correct operation.

There is therefore a need to make available a device for selection of capsules from a stack of capsules, which device is automated, reliable and robust over a number of repeated cycles. It must also be of a simple design and rapid action, but must be able to adapt to capsules of different sizes and shapes. Some capsules of a flat shape tend to become poorly positioned, and the release of these capsules from a stack is problematic. Thus, the device must allow the capsules to be released in such a way as to avoid the capsules becoming jammed and lying askew.

For this purpose, according to a first aspect, the invention concerns a device for selection of capsules from a stack of capsules contained in a container, comprising:

a body which delimits a passage through which the capsules pass by gravity, starting in order from the first capsule situated lowest down in the stack;

first stop means for selectively retaining and releasing said first capsule; said first stop means being distributed about the circumference of the passage and being able to move by turning transversely, and simultaneously, towards the inside of the passage to a stop position in order to form several support points distributed under the capsule;

second stop means configured to retain a second capsule situated above the first capsule in the stack at the moment when the first stop means are in the release position for releasing the first capsule, actuating means for actuating said stop means between a stop position and a release position;

characterized in that each first stop means and second stop means are attached to a common transmission shaft mounted in rotation on the body near the periphery of the passage.

Such a configuration satisfies the requirements of a device that is reliable. Thus, the first capsule is held in a stable manner at several distributed locations, which prevents tilting, upon release of the capsule, and possible jamming of the capsule. The attachment of each first and second stop means to a common transmission shaft ensures reliable synchronized release/retention of the capsules while at the same time reducing the complexity of the system. In particular, the movement of the first and second stop means, between a deployed position and a retracted position, and vice versa, takes place in phase opposition and always at a constant angle of rotation, of the order of 90 degrees, without possible variation.

The first stop means are preferably at least three or four in number and are distributed regularly about the circumference of the passage. This is because the stability of the capsule is greatly improved when the stop means are present in sufficient number. Moreover, the number and distribution of these stop means around the passage helps the downward travel of the capsule in such a way as to avoid skewed positioning and jamming which may result, in particular, at the outlet from the device.

Moreover, the shape of the stop means proves to be very important, especially for ensuring a good hold in a horizontal plane and for thus avoiding the capsule being released askew. For this purpose, the first stop means are formed by fingers which are configured to create support lines or support surfaces under the capsule and extending substantially towards the centre of the passage in the stop position.

The first stop means preferably terminate in free ends which are movable in such a way as to describe an arc portion. Thus, the movement of the stop means is akin to that of a diaphragm, such that, upon release of the capsule, the support of the capsule decreases gradually and in a manner distributed around the capsule. This contributes to keeping the capsule stable and to releasing it in a way which avoids the capsule leaving askew.

According to the invention, the device comprises second stop means which are configured in order to retain the second capsule situated above the first capsule in the stack at the moment when the first stop means are in the release position for releasing the first capsule. Thus, the first and second stop means cooperate in a synchronized manner so as to selectively release the first capsule while ensuring that the other capsules in the stack are held in place. This synchronization contributes to the reliability of the system and guarantees its correct operation; it is thus possible to imagine its being used in any type of dispensing system, including an automated system with or without payment system.

In the same way as with the first stop means, the second stop means turn transversely, and simultaneously, towards the inside of the passage to a stop position, in order to form several support points distributed under the second capsule. This is because it is also important to keep the stack of capsules above the first capsule as stable as possible and to avoid this stack coming to lie askew. Poor positioning may in fact affect the free downward movement of the capsules in the space assigned to them, for example in a tube. Poor positioning of the second capsule may also make its descent against the first stop means incorrect.

In the same way as with the first stop means, the second stop means are at least three or four in number and are distributed regularly about the circumference of the passage.

Likewise, the second stop means preferably terminate in free ends which are movable and describe an arc portion. In this way, the downward movement of the second capsule is obtained by a diaphragm effect which ensures a horizontal descent and reduces the risk of the second capsule becoming jammed.

Each second stop means is also attached to a transmission shaft mounted in rotation on the body near the periphery of the passage; this rod is the same as the one for each first stop means. Such a configuration helps guarantee perfect synchronization of the movements of both the first and second stop means. Moreover, each first stop means and each second stop means are thus attached to a transmission shaft and together form, transversely with respect to the passage, an L-shape in such a way as to take up stop positions in phase opposition. The effect of such a construction is to ensure good synchronization in the release and the retention of the capsules, while keeping the number of components used as low as possible.

According to an advantageous design principle, the transmission shafts are actuated in unison by means of a ring fitted on the circumference of the passage, which ring is actuated alternately between the stop positions of the first and second stop means. This principle ensures that all the first stop means are actuated simultaneously, and that all the second stop means are actuated simultaneously, but so as to move in phase opposition in relation to the movements of the first stop means.

Such a device can be operated by actuating means of any type. In one possible configuration, the actuating means comprise electrical means of the solenoid type. In one possible configuration, the actuating means also comprise mechanical means of the crankshaft type. It will be appreciated that the electrical means could be replaced by a manual control of the type involving a lever, slide or the like.

According to a second aspect of the invention, the selection device comprises:

a body which delimits a passage through which the capsules pass by gravity, starting in order from a first capsule situated lowest down in the stack;

first stop means for selectively retaining and releasing said first capsule; said first stop means being distributed about the circumference of the passage and being able to move by turning transversely, and simultaneously, towards the inside of the passage to a stop position in order to form several support points distributed under the capsule;

actuating means for actuating said stop means between a stop position and a release position;

characterized in that each first stop means forms a finger terminating at its free end with an end portion which has a shape complementing the shape of the end portion of the other stop means and which, on being deployed, substantially touches at least one edge of one of the other end portions in such a way as to form a support surface in a central zone of the seat.

With such a configuration of the stop means, it is possible, upon downward movement of a new first capsule, to receive the latter in a way which ensures that it does not become wedged between the first stop means. As the capsules have a relatively flat shape, the risk of their becoming wedged in the device is considerable. This configuration ensures improved reliability in terms of the correct positioning of the capsules before their release. Therefore, the device can also be operated at high speed, with less risk of jamming.

In one embodiment, the end portions therefore join at the centre of the passage in order to form a central support surface of substantially continuous shape. The term "continuous" signifies that the adjoining portions of the stop means join on at least one common edge, without play or at least with reduced functional play of the order of at most a millimeter, or less.

The support surface preferably extends in the central zone across at least 10% of the total diameter of the passage optimally, the support surface extends across about 20% or more of the diameter of the passage. For example, the support surface can have a shape which is substantially circular or annular, or a regular or irregular polygon. The shape of this surface is not critical per se.

These characteristics and their advantages, and other possible ones, will be better understood from the following description and from the attached drawings, in which.

Figure 1:
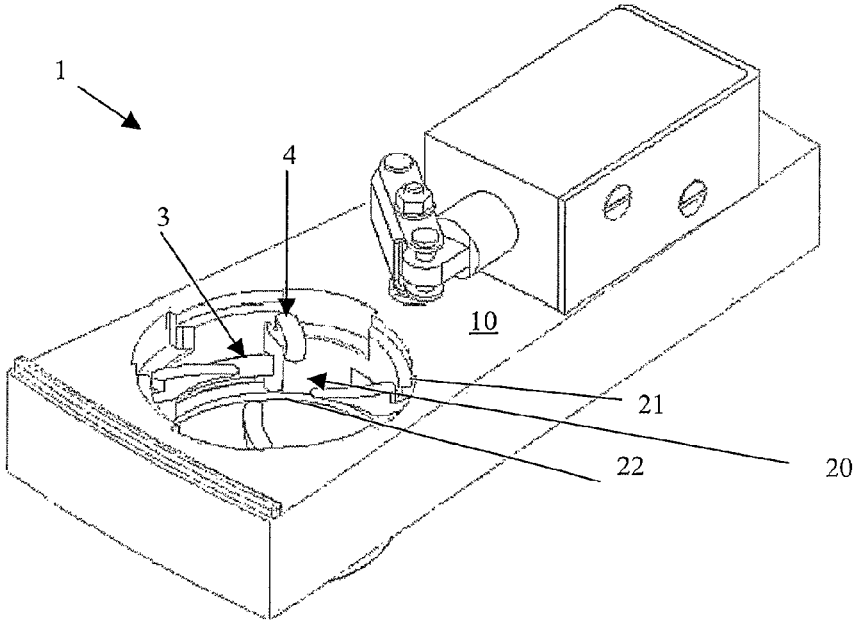
FIG. 1 shows a perspective view of a selection device according to the invention, without capsules.
Figure 2:
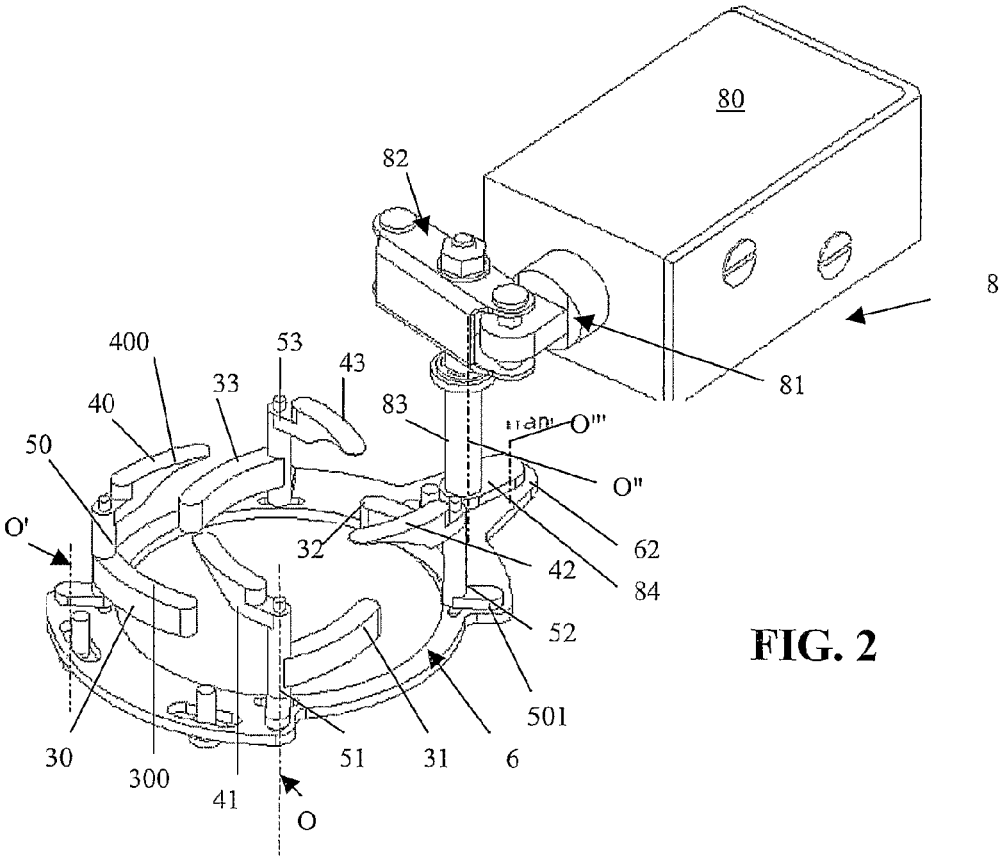
FIG. 2 shows the device from FIG. 1, without the body.
Figure 8:
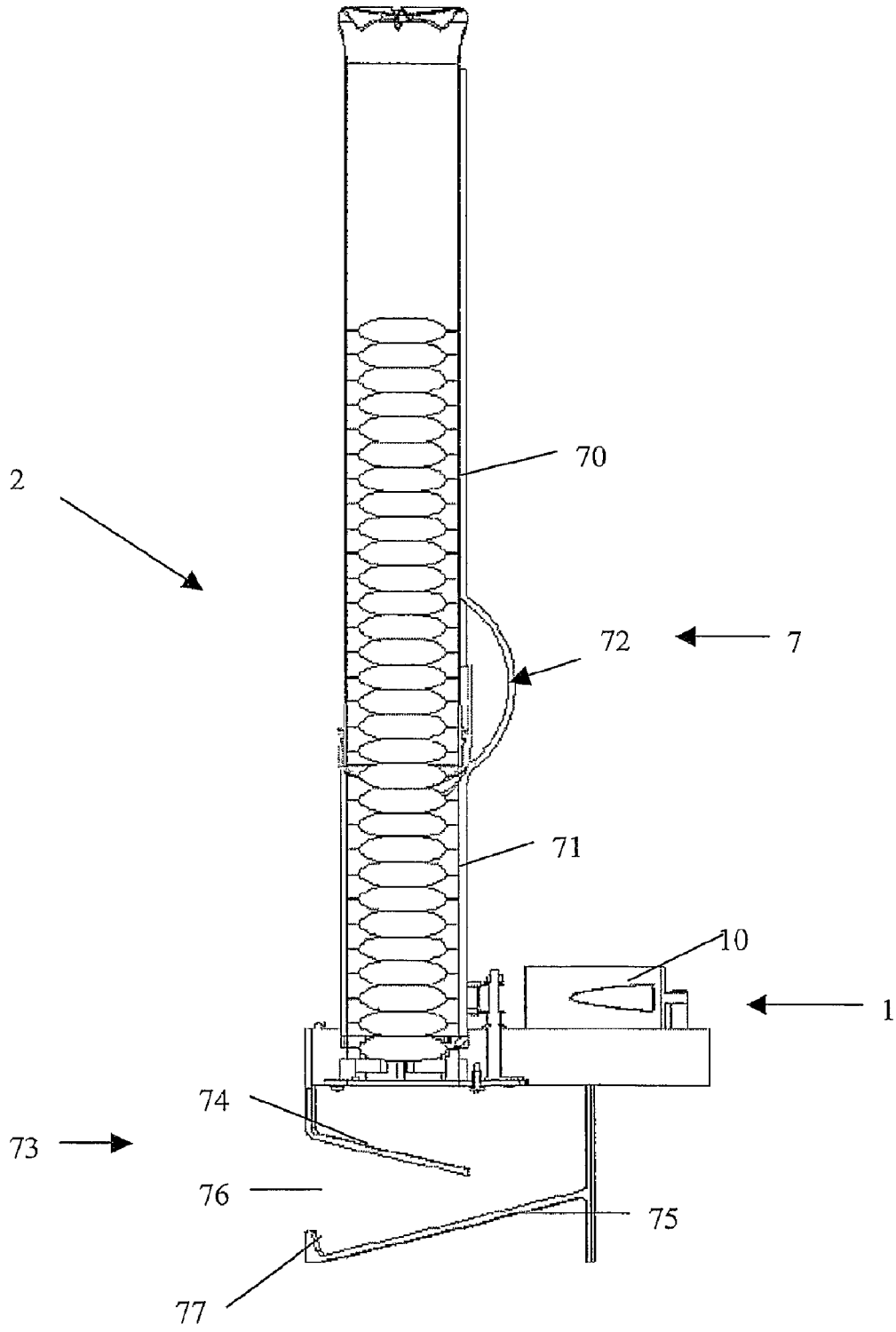
FIG. 8 shows a cross section of a capsule-dispensing module which comprises the device according to the invention.

The present invention relates to a device for selection of capsules which is of the type shown in FIGS. 1 and 2, which illustrate a preferred example, and which is designated by reference number 1. Each capsule contains a dose of a food product, such as ground coffee for example. The device 1 thus comprises a body 10 on which the main elements are mounted. The body 10 delimits a passage 20 whose cross section is adapted in size and shape for the capsules to pass through. The passage 20 is typically arranged in line with a store of capsules situated above the passage and coaxial with the latter. Such a store of capsules can be in the form of a stack of capsules contained in a container, as is shown in FIG. 8, and as will be explained in detail later in the description.

The device comprises first stop means 3 and second stop means 4, which means 3, 4 are arranged at two different levels in the passage 20. The first stop means 3 are used to hold the first capsule in the stack in place before its release. The first capsule is understood as being the capsule which is able to be released by the first stop means. When supported by the first means, the first capsule can be positioned at a certain distance below the other stacked capsules. The second stop means 4 are used to hold the capsule following this first capsule, when the first capsule is released by the first stop means. For reasons of clarity, the following capsule is thus called the "second capsule" in the present application.

The first stop means 3 comprise a series of stop elements in the form of fingers 30, 31, 32, 33 which are distributed about the circumference of the passage 20. These elements are at least three or four in number so as to ensure stability and a sufficient hold of the capsule. The number of stop elements depends on the size and/or the shape of the capsule. For example, for capsules which are of lenticular shape and relatively wide, of the order of 40 mm or more in diameter, the number of stop elements is preferably at least four and they are distributed uniformly about the circumference of the passage, for example at about 90 degrees between two elements. The stop elements provide the capsule with support along a surface 300 or a line which extends, in the deployed position, towards the inside of the passage.

Figure 4:
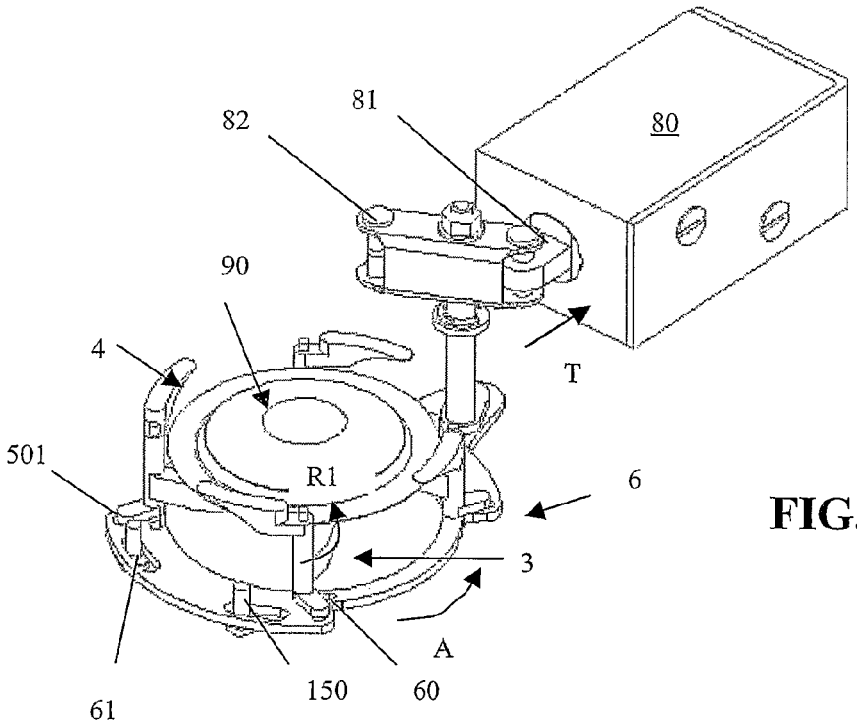
FIG. 4 shows the device from FIG. 3, without the body.

Second stop means 4 in the form of stop elements 40, 41, 42, 43 of substantially the same shape are provided at a vertical distance of about one capsule thickness above the stop elements 30, 31, 32, 34 of the first means. The first and second stop means are respectively mounted in pairs 30, 40; 31, 41; 32, 42; 33, 43 on transmission shafts 50, 51, 52, 53. Each pair is mounted in such a way as to form an "L" oriented transversely with respect to the passage. The transmission shafts 50, 51, 52, 53 are mounted in rotation relative to the body on an axis passing through their centre O. It will be appreciated that the transmission shaft thus ensures a constant angular displacement of the stop means. This angular displacement is about 90 degrees. All the transmission shafts are also connected to one another by a transmission ring 6 which is configured so as to move the shafts in rotation when the ring is itself forced into an alternating pivoting movement with respect to the centre of the passage. For this purpose, the shafts comprise a base 501 which is fixed on the ring via a pivot point on an axis O', offset externally with respect to the axis O, thus making it possible to transmit the movement of rotation to the shaft during the pivoting movement of the ring. Each shaft is finally mounted in an oblong slot 60 of the ring, which ensures that the shaft is guided in rotation. As is shown in FIG. 4, in order to maintain the ring correctly with respect to the body, the ring comprises a series of oblong slots 61 traversed by fixing elements 150 which are connected to the body. The ring can thus pivot, guided with respect to the elements 50, 51, 52, 150, by an amplitude determined by the length of the slots. This amplitude is thus a function of the amplitude of movements of the first and second stop elements for ensuring their functions of stopping and releasing the capsules.

The pivoting movement of the ring 6, allowing the rotation to be transmitted to the shafts, is controlled by actuating means 8 which can comprise an electrical control system such as a solenoid 80. After receiving an electrical impulse, such a system is able to transmit a reciprocating linear movement by means of a piston 81. This piston 81 is articulated on a crankshaft 82 which converts this linear movement of the piston into a circular movement transmitted to a shaft 83 at the axis O". This circular movement of the shaft 83 is transmitted to the ring 6 by a lever arm 84 which is fixed in rotation along O'" on an extension 62 of the ring 6. Thus, a reciprocating movement of the piston 81 of the solenoid has the effect of pivoting the ring in a guided manner in the slots and of transmitting a rotation movement to the shafts, which themselves move the stop means in phase opposition and to two possible positions. The return movement of the piston of the solenoid can be controlled either by electrical impulse or by a restoring spring (not shown).

It should be noted that the first and second stop means have free ends 300 and 400, respectively, which are remote from those mounted on the transmission shaft and which thus move along an arc portion. This arc portion is inscribed in intersection with the edge 21 of the passage 20 and extends in the direction of the inside of the passage, with the result that the stop means withdraw, reducing the support of the capsule, from the inside 22 towards the edge 21 of the passage, in the manner of a diaphragm.

The movement of the stop means is more clearly illustrated with reference to FIGS. 3-7.

Figure 3:
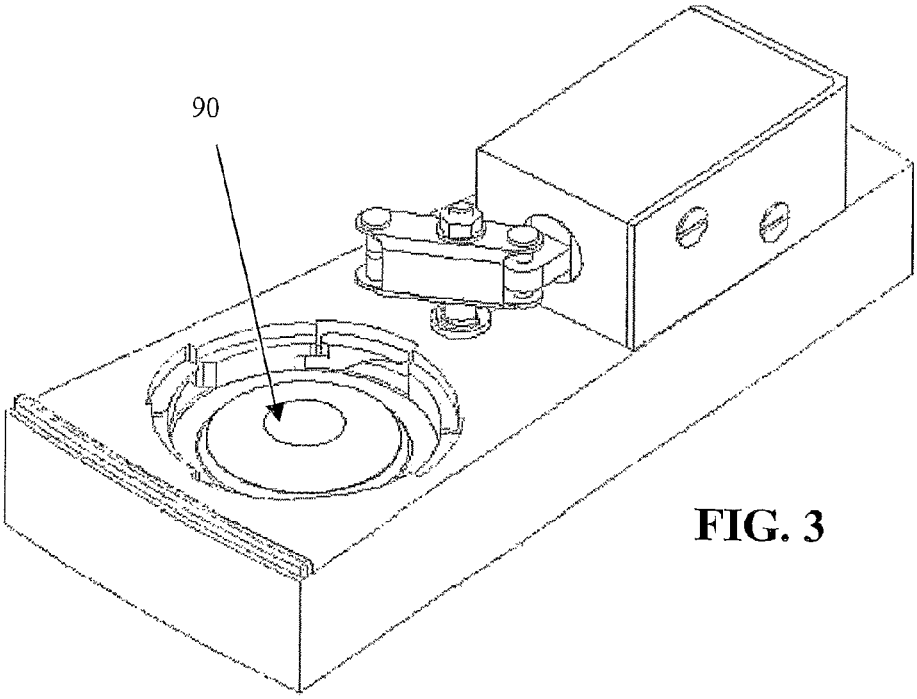
FIG. 3 shows a perspective view of the device with a first capsule held by the first stop means.

FIGS. 3 and 4 show a first capsule 90 held on the first stop means 3 when the latter are turned into the position towards the inside of the passage. In this position, the piston of the solenoid is thus in a retracted position. The second stop means are in the release position; this allows the stack of capsules to come into contact with the first capsule 90. For reasons of clarity, the stack of capsules is not shown, except for the first capsule. By pulling in the direction T, the piston drives the ring in the direction of pivoting A; this has the effect of transmitting a rotation movement R1 to the transmission shafts and, consequently, of deploying the first stop elements 3.

Figure 5:
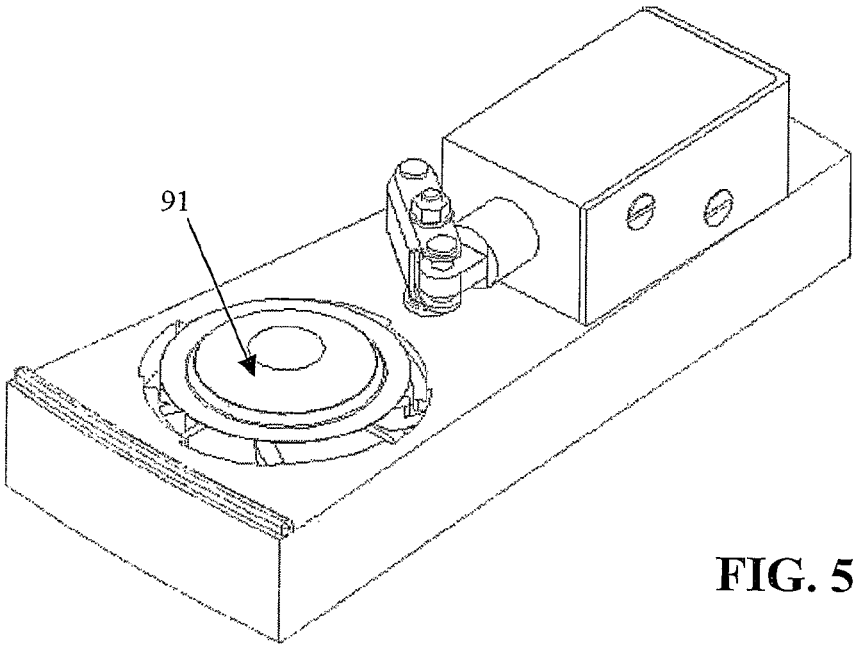
FIG. 5 shows a perspective view of the device with a second capsule held by the second stop means.
Figure 6:
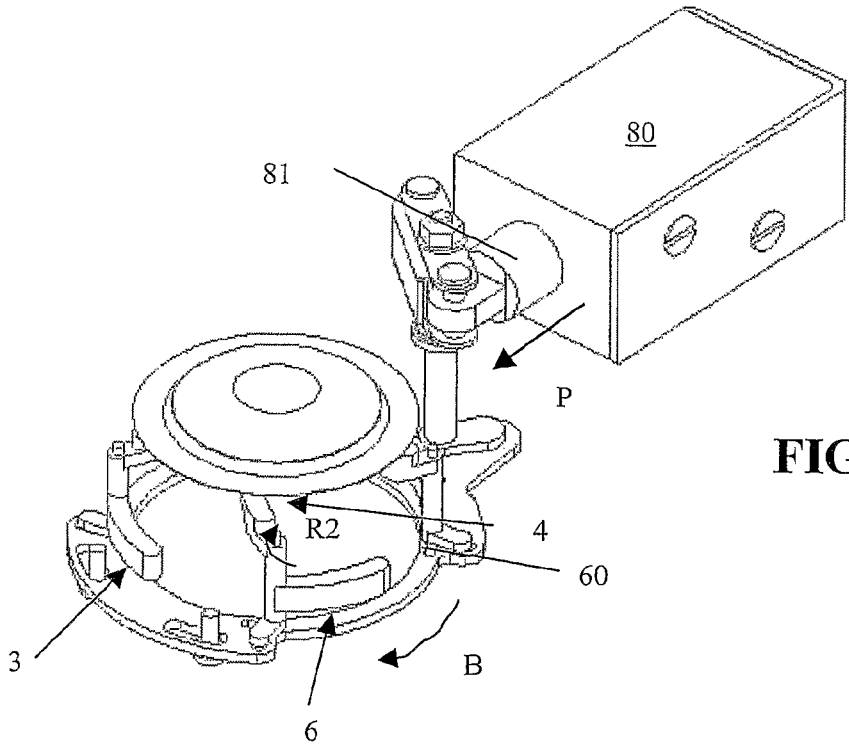
FIG. 6 shows the device from FIG. 5.
Figure 7:
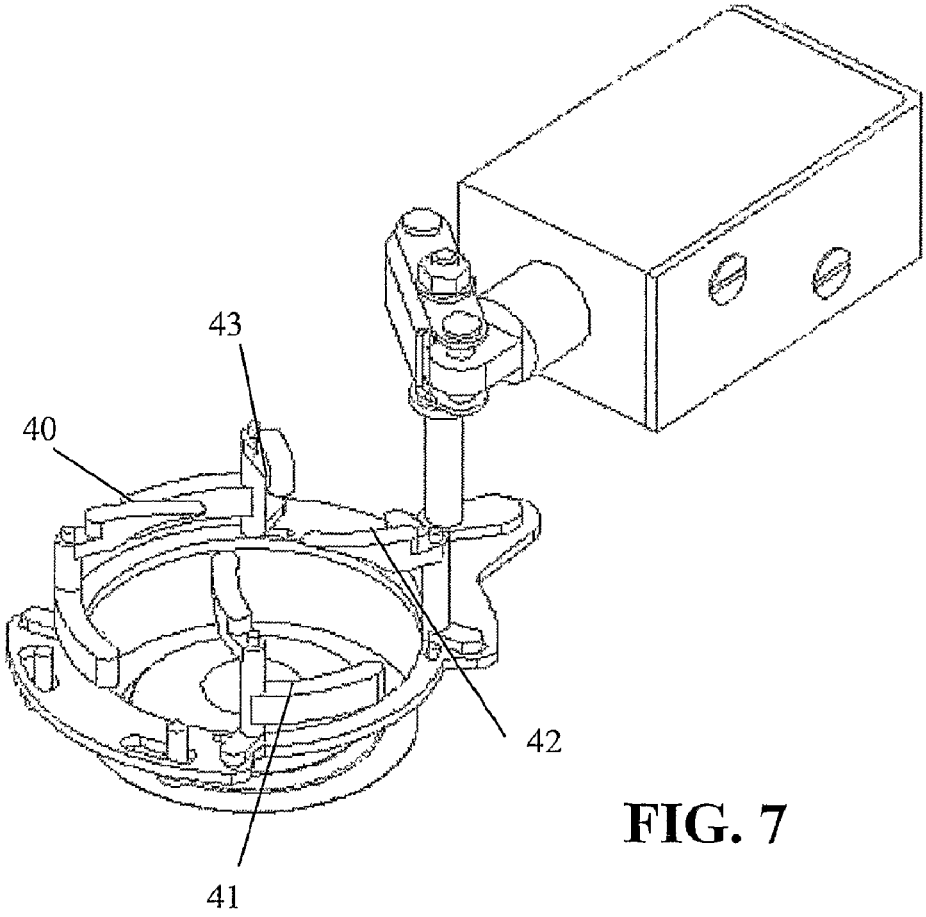
FIG. 7 shows the device upon release of a first capsule by the first stop means.

FIGS. 5 and 6 show a second capsule 91 being held, while FIG. 7 shows the release of the first capsule 90; these figures, however, show the device in a same configuration of the stop means. In this configuration, the first stop means 3 are thus withdrawn; this means that the second stop means 4 are brought into the deployed position and hold the second capsule 91 in the stack at the moment of release of the first capsule 90. The change to this new configuration is obtained by operation of the actuating means, in particular of the piston, which assumes a deployed position. By pushing in the direction P, the piston drives the ring in the direction of pivoting B; this has the effect of transmitting a rotation movement R2 to the transmission shafts and thus of causing the second stop means 4 to deploy. The effect of this deployment is to prevent downward movement of the stack of capsules, while the first capsule 90 is released. After release of the first capsule 90, the device returns to the configuration in FIGS. 3 and 4 by the piston returning to the withdrawn position and causing the second capsule 91 to drop into contact with the first stop means 3, so that it thus becomes the new first capsule which can be selected for release at the desired moment. The return movement of the piston can be effected by a restoring spring, for example. These cycles are repeated for individual selection of the capsules from the stack.

FIG. 8 shows a device 2 for dispensing capsules from a stack of capsules in a recharging system using the selection device 1 according to the invention. The dispensing device 2 comprises a charging system 7 having a removable tube 70 connected to a receiving tube portion 71 mounted permanently on the body 10 of the selection device. The receiving tube support 71 is able to receive a certain number of capsules, allowing the removable tube 70 to provide capsule replacements. The removable tube 70 and the tube support 71 can be linked by alignment means 72 whose function is to allow the removable tube 70 to be connected to the tube support 71 quickly and without allowing capsules to be lost from the system.

Figure 9:
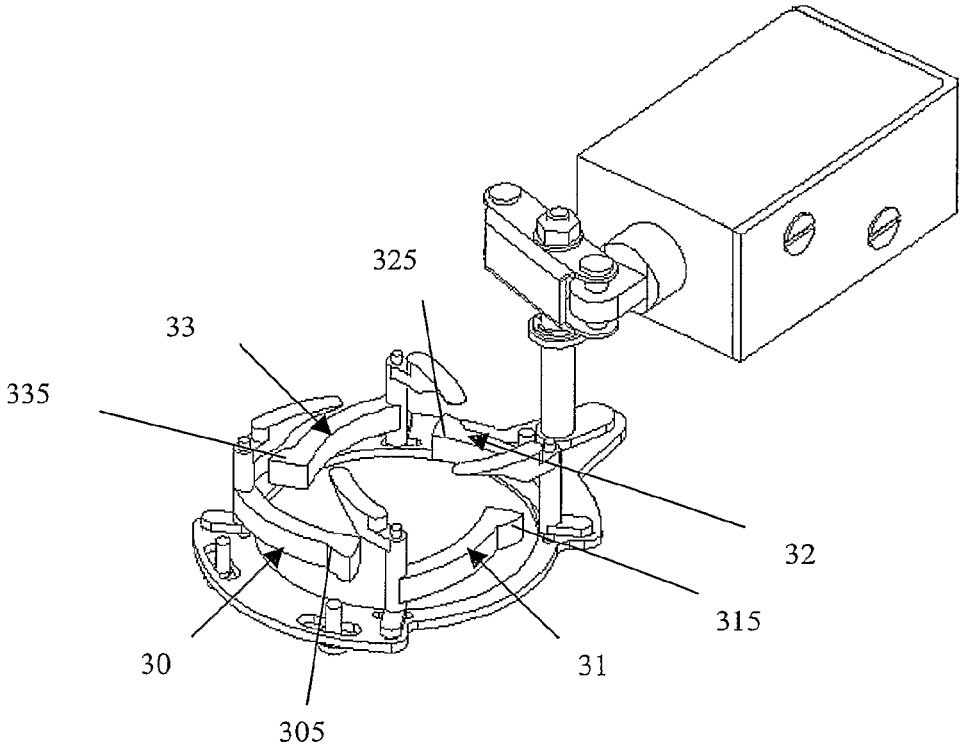
FIG. 9 shows a perspective view similar to FIG. 2, in a variant of the invention.
Figure 10:
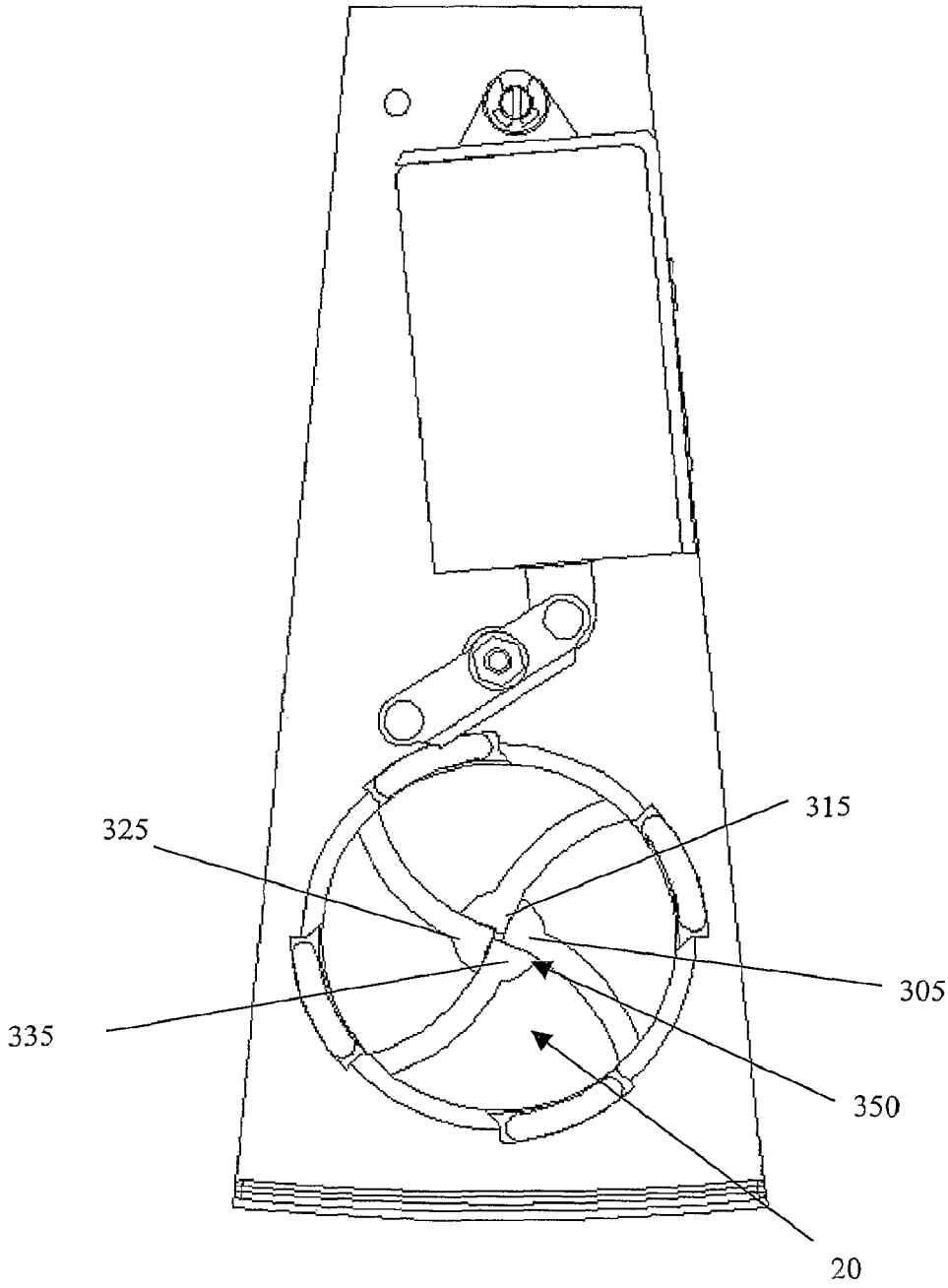
FIG. 10 shows a plan view of FIG. 9.

FIGS. 9 and 10 show a different embodiment in terms of the form of the first stop means 30, 31, 32, 33. These first stop means 30, 31, 32, 33 terminate at their free end with a respective end portion 30*a*, 30*b*, 30*c*, 30*d* having a shape complementing each other so as to form edges which join each other when deployed to hold a first capsule. A support surface 350 is thus formed, as is shown in FIG. 10.

Such a configuration has the advantage that, when the capsule is released by the second stop means, it ensures that the edge of this capsule does not pass through the stop means and thus come to lie askew in these. Even if the capsule drops against the stop means, because of the distance separating the first and second stop means, the support surface thus formed forces the capsule to level out again and to position itself correctly in the seat on the stop means.

The support surface formed by the stop means in the deployed position can extend into the central zone across at least 10% of the total diameter of the passage 20. It preferably extends across about 15 to 50% of the diameter of the passage. Beyond this, the system becomes more cumbersome upon deployment of the stop means, and without becoming any more effective; which is disadvantageous in the context of an array of selection means placed side by side.

Positioned underneath the passage of the selection device 1, there is a capsule-recovering unit 73 comprising a first ramp 74 for directing the capsule onto a second ramp 75 which delimits a clearance 76 for recovery of the capsule. The second ramp comprises a shoulder 77 for arresting the sliding of the capsule. The ramps 75, 76 are positioned in such a way as to present opposite slide surfaces intended to guarantee improved tamperproofing of the device. The dispensing device can be connected to a control means such as a control button which controls the actuating means and a payment system for activation of the control means (not shown). The payment system can be in the form of a change machine and/or a module for payment by magnetic card or smart card or alternatively by remote payment means, for example telecommunication and/or multimedia.

The dispensing device and the charging system are described in detail in co-pending European patent application No. 0401644.5, filed 5 May 2004 and having as its title "Capsule-loading device for a machine for dispensing capsules and/or food products", the entire content of which is incorporated in the present application by reference.

The invention has been described on the basis of preferred examples. However, it will be appreciated that the invention can include alternatives or equivalents within the scope of the skilled person and covered by the attached claims.

The invention claimed is:

1. A device for selection of capsules from a stack of capsules contained in a container, comprising:

a body having a passage through which the capsules pass by gravity, starting in order from a first capsule located at a position lowest down in the stack;

a first stop for selectively retaining and releasing the first capsule the first stop being located about a circumference of the passage and moveable by turning transversely, and simultaneously, towards an inside of the passage to a stop position in order to form several support points distributed under the capsule;

a second stop retaining a second capsule located above the first capsule at a time when the first stop is in a release position for releasing the first capsule, an actuator for actuating the first and second stop between a stop position and a release position; and each first stop and second stop being attached to a common transmission shaft pivotably mounted in an individual slot of a rotatable transmission ring near a periphery of the passage, wherein the transmission shaft is configured to traverse the individual slot between a first and second position corresponding to actuation of the first and second stops, and wherein the first and second stops terminate in free ends that are remote from ends mounted to the transmission shaft, the free ends having an arc shape and extending substantially toward a center of the passage in the stop position.

2. The device according to claim 1, wherein the first stop includes at least three stop members distributed about the circumference of the passage.

3. The device according to claim 1, wherein the first stop comprises fingers which define support surfaces under the capsule.

4. The device according to claim 1, wherein each first stop is attached to a transmission shaft mounted on the rotatable transmission ring near the periphery of the passage in such a way as to allow the first stop to be movable.

5. The device according to claim 4, wherein the second stop can turn transversely, and simultaneously, towards the inside of the passage to a stop position, forming several support points located under the second capsule.

6. The device according to claim 5, wherein the second stop comprises at least three stop members distributed about the circumference of the passage.

7. The device according to claim 1, wherein the first stop and second stop are attached to a transmission shaft and together form, transversely with respect to the passage, an L-shape so as to provide stop positions in phase opposition.

8. The device according to claim 1, wherein the transmission shafts are actuated in unison by the rotatable transmission ring located on the circumference of the passage, the rotatable transmission ring is actuated alternately between the stop positions of the first and second stop.

9. The device according to claim 1, wherein the actuator comprises electrical means of a solenoid type.

10. The device according to claim 1, wherein the actuating means comprise mechanical means of a crankshaft type.

11. A device for dispensing a capsule, comprising a device for selection of capsules contained in a container, comprising:

a body having a passage through which the capsules pass by gravity, starting in order from a first capsule located at a position lowest down in the stack;

a first stop for selectively retaining and releasing the first capsule the first stop being located about a circumference of the passage and moveable by turning transversely, and simultaneously, towards an inside of the passage to a stop position in order to form several support points distributed under the capsule;

a second stop retaining a second capsule located above the first capsule at a time when the first stop is in a release position for releasing the first capsule;

an actuator for actuating the first and second stop between a stop position and a release position;

each first stop and second stop being attached to a common transmission shaft pivotably mounted in an individual slot of a rotatable transmission ring near a periphery of the passage; and, a capsule-loading system, and a capsule-recovering means, wherein the transmission shaft is configured to traverse the individual slot between a first and second position corresponding to actuation of the first and second stops, and wherein the first and second stops terminate in free ends that are remote from ends mounted to the transmission shaft, the free ends having an arc shape and extending substantially toward a center of the passage in the stop position.

12. A device for selection of a capsule from a stack of capsules contained in a container, comprising:

a body which comprises a passage through which the capsules pass by gravity, starting in order from a first capsule situated at a position that is lowest in the stack;

a first stop for selectively retaining and releasing the first capsule; the first stop being located at a circumference of the passage and being moveable by turning transversely, and simultaneously, towards the inside of the passage to a stop position forming several support points distributed under the capsule;

a second stop for selectively retaining and releasing a second capsule located above the first capsule at a time when the first stop is in a release position for releasing the first capsule, each first stop and second stop being attached to a common transmission shaft;

an actuator for moving the first stop between a stop position and a release position; and the first stop comprises a finger terminating at a free end with an end portion which has a shape that is complementary to a shape of the end portion of another finger of the first stop and which, on being deployed, substantially touches and does not overlap at least one edge of one of the other end portions forming a support surface in a central zone of a seat.

13. The device for selection of a capsule according to claim 12, wherein the end portions join at the centre of the passage forming a support surface of substantially continuous shape.

14. The device for selection of a capsule according to claim 12, wherein the support surface extends in the central zone across at least 10% of a total diameter of the passage.

15. The device for selection of a capsule according to claim 13, wherein the support surface has a shape which is selected from the group consisting of substantially circular, annular, regular, and irregular polygon.

16. A device for dispensing capsules from a stack of capsules comprising:

a body for housing and dispensing;

a first stop that retains and releases a first capsule, located at a circumference of an opening of the body and being moveable to a stop position that provides support points under the capsule;

a second stop for retaining a second capsule when the first stop releases the first capsule;

an actuator for moving the first stop between a stop position and a release position; and each of the first stop and the second stop is attached to a common transmission shaft that can pivot in an individual slot on a transmission ring near the periphery of the opening wherein the transmission shaft is configured to traverse the individual slot between a first and second position corresponding to actuation of the first and second stops, and wherein the first and second stops terminate in free ends that are remote from ends mounted to the transmission shaft, the free ends having an arc shape and extending substantially toward a center of the passage in the stop position.

* * * * *